US009214774B2

(12) United States Patent
Cao

(10) Patent No.: US 9,214,774 B2
(45) Date of Patent: Dec. 15, 2015

(54) WEDGE CONVERTER

(71) Applicant: CAO Group, Inc., West Jordan, UT (US)

(72) Inventor: Densen Cao, Sandy, UT (US)

(73) Assignee: EPISTAR CORPORATION, Hsinchu (TW)

( * ) Notice: Subject to any disclaimer, the term of this patent is extended or adjusted under 35 U.S.C. 154(b) by 0 days.

(21) Appl. No.: 13/842,531

(22) Filed: Mar. 15, 2013

(65) Prior Publication Data

US 2014/0273668 A1 Sep. 18, 2014

(51) Int. Cl.
*H01R 31/06* (2006.01)
*H01R 33/09* (2006.01)

(52) U.S. Cl.
CPC ..... *H01R 31/06* (2013.01); *H01R 33/09* (2013.01)

(58) Field of Classification Search
USPC ..... 439/883, 21; 362/294, 240, 500
See application file for complete search history.

(56) References Cited

U.S. PATENT DOCUMENTS

| | | | | |
|---|---|---|---|---|
| 4,678,437 | A * | 7/1987 | Scott et al. | 434/21 |
| 5,669,703 | A * | 9/1997 | Wheeler et al. | 362/249.04 |
| 6,644,839 | B2 * | 11/2003 | Lee | 362/500 |
| 8,287,142 | B2 * | 10/2012 | Pickard et al. | 362/148 |
| 8,696,158 | B2 * | 4/2014 | Santiago et al. | 362/249.02 |
| 2001/0013748 | A1 * | 8/2001 | Ishihara | 313/318.09 |
| 2004/0262472 | A1 * | 12/2004 | Thomas | 248/220.21 |
| 2005/0276063 | A1 * | 12/2005 | Coushaine et al. | 362/555 |
| 2009/0284958 | A1 * | 11/2009 | Pickard et al. | 362/147 |
| 2009/0296390 | A1 * | 12/2009 | Dubord | 362/240 |
| 2011/0228544 | A1 * | 9/2011 | Dubord | 362/368 |
| 2012/0268008 | A1 * | 10/2012 | Miskin et al. | 315/86 |
| 2013/0088880 | A1 * | 4/2013 | Duan et al. | 362/373 |
| 2013/0235598 | A1 * | 9/2013 | Beausoleil | 362/382 |
| 2013/0285530 | A1 * | 10/2013 | LIN et al. | 313/51 |
| 2014/0071687 | A1 * | 3/2014 | Tickner et al. | 362/294 |
| 2014/0334184 | A1 * | 11/2014 | Yamanaka et al. | 362/657 |

* cited by examiner

*Primary Examiner* — Alexander Gilman
(74) *Attorney, Agent, or Firm* — Ditthavong & Steiner, P.C.

(57) ABSTRACT

Embodiments of the present invention include devices for converting a bi-pin interface to a wedge interface in a light-emitting-diode (LED) lighting system. The ultimate purpose of the invention is to reduce the cost, service time, and risk challenges faced by LED-lighting servicers. The invention accomplishes this purpose by neutralizing the challenge imposed by unknown inventory requirements.

7 Claims, 7 Drawing Sheets

WEDGE CONVERTER

TECHNICAL FIELD OF THE INVENTION

The present invention relates to lighting systems and connection devices to use with lighting systems and devices.

BACKGROUND OF THE INVENTION

As global energy conservation efforts increase and businesses and individuals seek to reduce utility costs and carbon footprints, low-power lighting systems have grown increasingly important. Advances in semiconductor lighting have enabled viable methods for achieving low-power lighting systems. Namely, light-emitting-diode (LED) lighting systems comprising LED light bulbs can significantly reduce power consumption relative to conventional light bulbs, while providing excellent lighting. Because cost concerns slow the transition from conventional to LED lighting systems, reducing the cost of implementing LED lighting systems will help facilitate the transition.

One cost driver of servicing LED lighting systems is unknown inventory requirements. The uncertainty stems from the interface between the LED light bulb and its power source. LED light bulbs may interface to power sources in one of several ways, including wedge interfaces and pin interfaces. In the conventional art, interface type is inextricably tied to bulb type. For example, a bi-pin interface requires a bi-pin bulb, and a wedge interface requires a wedge bulb. One challenge LED-lighting-system servicers face is that they do not know beforehand which bulb type—and, in the case of complex systems, how many of each bulb type—a given lighting system requires. And often times, in the case of complex lighting systems, or systems that are difficult to access, customers will not be able provide this information. Conventional workarounds to this challenge include carrying double inventory and performing pre-service inspections.

In the double-inventory solution, servicers compensate for unknown inventor requirements by carrying two types of bulbs in inventory: bulbs designed for wedge interfaces and bulbs designed for pin interfaces. This effectively forces servicers to carry twice the amount of inventory than they would carry if they knew the interface type in advance. The servicer can implement the double-inventory solution by carrying the extra inventory in a vehicle, thereby saving a trip to the service site. But this requires larger vehicle. Alternatively, the servicer can implement the solution by carrying the extra inventory in a building. But this requires more storage space. Either way, the double-inventory solution increases market entry cost, financial risk, and storage space requirements.

The pre-service-inspection solution provides an alternative to the double-inventory solution. In the pre-service-inspection solution, a servicer visits the system site to determine the type and number of bulbs required. After the inspection, the servicer can purchase required inventory, thus alleviating the storage space problem created by double inventory, described above. But while this solution solves the double-inventory problem, it introduces new problems.

For example, the servicer must make an extra trip to the site, increasing the time and cost of a given job. Even if the servicer makes this pre-service inspection, determining the number of each type of bulb may be very difficult in complex systems. Furthermore, because the servicer must wait to purchase inventory until after the pre-service inspection, the servicer must make an additional extra trip: to purchase inventory. Alternatively, in situations in which the servicer relies on shipped inventory, shipping costs increase because the servicer loses shipping economies of scale. Shipping also introduces time lags. So, like the double-inventory solution, the pre-service-inspection solution increases cost and risk.

Whether a servicer implements the double-inventory solution or pre-service-inspection solution, overcoming the challenge created by unknown inventory requirements increases the cost of servicing LED lighting systems. Importantly, the costs incurred through conventional solutions must typically be passed on to consumers, decreasing the overall incentive to transition to LED lighting systems.

Accordingly, there are a number of disadvantages in the conventional art of LED lighting solutions.

SUMMARY OF THE INVENTION

Embodiments of the present invention include devices for converting a bi-pin interface to a wedge interface in a light-emitting-diode (LED) lighting system. The ultimate purpose of the invention is to reduce the cost, service time, and risk challenges faced by LED-lighting servicers. The invention accomplishes this purpose by neutralizing the challenge imposed by unknown inventory requirements.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific example embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings.

DETAILED DESCRIPTION OF THE INVENTION

Embodiments of the present invention include devices for converting a bi-pin interface to a wedge interface in a light-emitting-diode (LED) lighting system. The ultimate purpose of the invention is to reduce the cost, service time, and risk challenges faced by LED-lighting servicers. The invention accomplishes this purpose by neutralizing the challenge imposed by unknown inventory requirements.

In one particular example embodiment, a converter comprising a body, two flanges, and two conductors function together to implement the bi-pin conversion. In this embodiment, a conductor passes through and around each flange to create two electrical interfaces. The first electrical interface couples to the wedge's electrical interface, while the second electrical interface couples to the bi-pin's electrical interface (i.e., the pins). The converter can be plugged into the wedge interface, whereupon a bi-pin-type LED light can plug directly into the converter and, by coupling through the converter, make an electrical connection to the wedge interface.

Thus, even when the LED-lighting interface type is unknown, if servicers carry converters, they need carry only bi-pin-type LED lights. Accordingly, as described herein, example embodiments of the present invention ultimately reduce inventory overheads, thus reducing the costs, service times, and risks that conventional solutions impose on providers and servicers of LED-lighting systems.

Figure 1A:
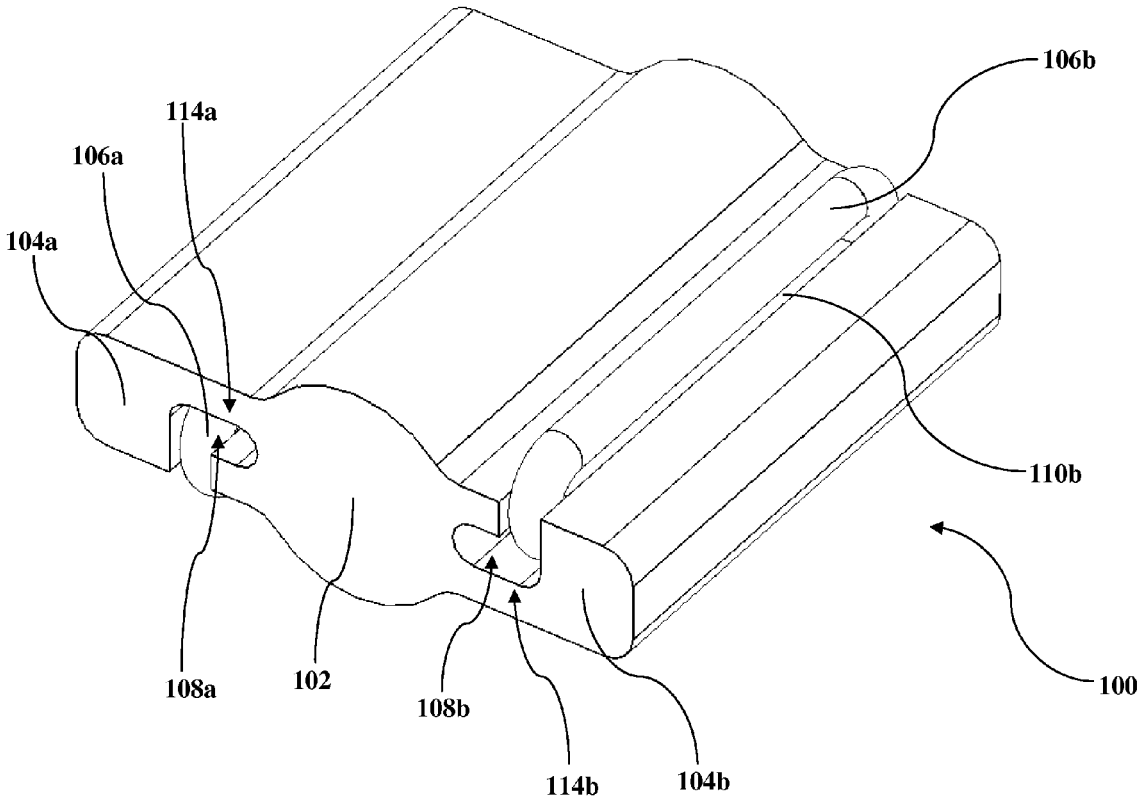
FIG. 1A depicts a perspective view of an example wedge converter.

Referring now to the drawings, example embodiments of the converter 100 will be discussed. The overall configuration of the converter 100 can vary from one embodiment to the next. For example, FIG. 1A illustrates that the converter 100 can comprise a substantially rectangular block geometric configuration with a substantially cylindrical body 102 extending through the middle of the block.

In other example embodiments, the converter 100 can also be formed in any other geometric configuration. For example, the converter 100 can simply comprise a substantially rectangular block geometric configuration without a body 102. But in some cases, the geometric configuration of the converter 100 can be limited by the geometric configuration of the wedge interface. Furthermore, the geometric configuration of the converter 100 can change according to the geometric configuration of the wedge interface and bi pins.

Like the converter 100, the elements and subelements it comprises (as described in detail below) can also vary in geometric configuration from one embodiment to the next. Furthermore, any two elements or subelements can be formed to have geometric configurations different and distinct from each other. For example, one element or subelement can be substantially rectangular while another element or subelement can be substantially cylindrical.

Notwithstanding its geometric configuration, the converter 100 can be made from a variety of materials. For example, the converter 100 can be made from variety of plastics. Such plastics can include PTFE, polyethylene, polypropylene, PFA, FEP, or ETFE. But other plastics or materials can be used as desired. Other embodiments can generally use any nonconductive material, such as glass or polymers, or any other material or combination of materials, according to demands, desires, and expected uses.

Like the converter 100, the elements and subelements it comprises (as described in detail below) can also be made from a variety of materials from one embodiment to the next. Furthermore, any two elements or subelements can be made from materials different and distinct from each other. For example, one element or subelement can be made from plastic while another element or subelement can be made from glass. In addition, the converter 100 can be formed using various methods, depending on the material from which it is formed. For example, the converter 100 can be formed using casting, forging, or carving.

In addition to various materials, the converter 100 can be configured in various sizes. For example, the converter 100 can be about one inch wide, about one inch long, and about one-quarter inch thick, a size that can generally fit well with a standard wedge interface. But this size can vary depending on the size of both the wedge interface and the bi pins with which the converter 100 is designed to interface.

As generally described above, the converter 100 can comprise a body 102, flanges 104*a/b*, and conductors 106*a/b*. The flanges 104*a/b* can extend from the body 102 to substantially conform to a wedge interface such that each pin of the bi-pin interface can be coupled to a pin of the wedge interface while being supported by the flanges 104*a/b*.

As illustrated in FIG. 1A, in one example embodiment, the first flange 104*a* can couple a first pin of the bi-pin interface to a wedge's first electrical interface; this coupling is done using the first conductor 106*a*. Also illustrated in FIG. 1A, a second flange 104*b* can couple a second pin of the bi-pin interface to a wedge's second electrical interface; this coupling is done using the second conductor 106*b*.

Similar to, and often in conjunction with, the converter 100, the overall configuration of the body 102 can change from one embodiment to the next. Specifically, as an element of the converter 100 (as described above), the body 102 can be formed in a variety of geometric configurations, materials, and sizes. In one example embodiment, as illustrated in FIG. 1A, the body can be substantially cylindrical and run through the center of the converter 100. As will be described below, the overall configuration of the body 102, and particularly its geometric configuration and size, can be substantially dependent on the configuration of wedge interface.

Like the body, the overall configuration of the flanges 104*a/b* can change from one embodiment to the next. Specifically, as an element of the converter 100 (as described above), the flanges 104*a/b* can be formed in a variety of geometric configurations, materials, and sizes. In one example embodiment, as illustrated in FIG. 1A, the flanges 104*a/b* extend from the body and are substantially rectangular, having rounded corners. As will be described below, the overall configuration of the flanges 104*a/b*, and particularly their geometric configuration and size, can be substantially dependent on the configuration of the wedge interface. For example, the flanges 104*a/b* can be about nine millimeters long, about three millimeters wide, and about two millimeters thick, a size that can lend itself well to typical bi-pin and wedge interfaces.

As will be described below, the overall configuration of each flange 104*a/b*, and particularly its geometric configuration and size, can be substantially dependent on the configuration of the elements it can comprise. Specifically, as generally described above and illustrated in FIGS. 1A and 1B, each flange 104*a/b* can comprise an interior wall 114*a/b*, a hollow extension 108*a/b*, a bridge 110*a/b*, and a channel 112*a/b*.

Figure 1B:
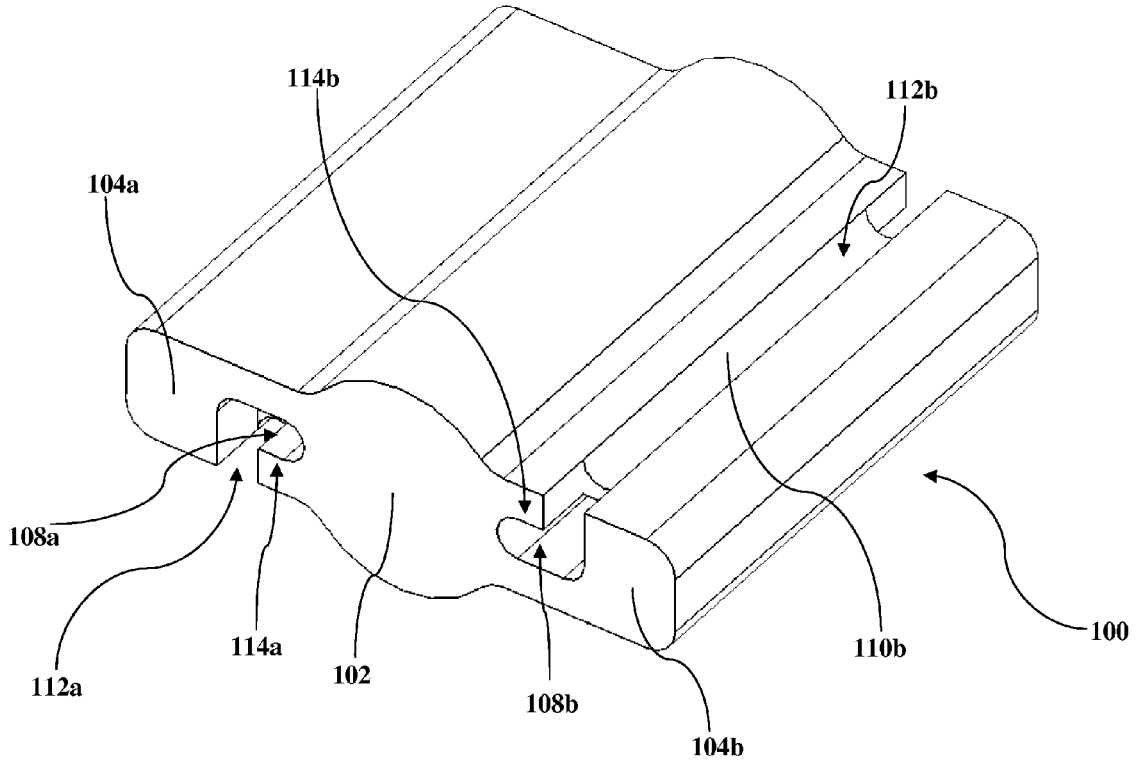
FIG. 1B depicts a perspective view of an example wedge converter illustrating various elements.

Like the flange 104*a/b*, the overall configuration of the interior wall 114*a/b* can change from one embodiment to the next. For example, as a subelement of the converter 100 (as described above), the interior wall 114*a/b* can be formed in a variety of geometric configurations, materials, and sizes. FIG. 1D illustrates that the interior wall 114*a/b* can, for example, be a substantially rectangular with rounded corners, defining a hollow extension of substantially the same shape.

Notwithstanding the geometric configuration of the interior wall 114*a/b*, the interior wall 114*a/b* can generally be formed from the same material as the flange 104*a/b*. As described above, this material can vary from one embodiment to the next.

In addition to various materials, the interior wall 114*a/b* can be configured in various sizes. For example, the interior wall 114*a/b* can be about one millimeter wide and 0.72 millimeters long, and nine millimeters deep, a size that can lend itself well to typical bi-pin and wedge interfaces. But this size can vary from one embodiment to the next, depending on the size of the bi-pin and wedge interfaces.

In a fashion similar to and often in conjunction with the interior wall 114*a/b*, the overall configuration of the hollow extension 108*a/b* can change from one embodiment to the next. For example, as a subelement of the converter 100 (as described above), the hollow extension 108*a/b* can be formed in a variety of geometric configurations and sizes. FIG. 1E illustrates that the hollow extension 108*a/b* can, for example, be a substantially rectangular with rounded corners, defined by the interior wall of substantially the same shape.

In addition to various geometric configurations, the hollow extension 108*a/b* can be configured in various sizes. For example, the hollow extension 108*a/b* can be about one millimeter wide, 0.72 millimeters long, and nine millimeters deep, a size that can lend itself well to typical bi-pin and wedge interfaces. However, this size can vary from one embodiment to the next depending on the size of the bi-pin and wedge interfaces.

In a fashion similar to and often in conjunction with the hollow extension 108*a/b*, the overall configuration of the bridge 110*a/b* can change from one embodiment to the next. For example, as a subelement of the converter 100 (as described above), the bridge 110*a/b* can be formed in a variety of geometric configurations, materials, and sizes. FIGS. 1B and 1E illustrates that the bridge 110*a/b* can, for example, be a relatively thin strip, running the length of the hollow extension 108*a/b* and having surfaces defined by the interior wall 114*a/b* and the channel 112*a/b*. FIGS. 1B and 1E further illustrate that the bridge 110*a/b* can be formed such that these surfaces are substantially rounded. This allows the conductor 106*a/b* to fit snugly within the flange 104*a/b*.

Notwithstanding the geometric configuration of the bridge 110*a/b*, the bridge 110*a/b* can generally be formed from the same material as the flange 104*a/b*. As described above, this material can vary from one embodiment to the next.

In addition to various materials, the bridge 110*a/b* can be configured in various sizes. For example, the bridge 110*a/b* can be about 0.7 millimeters wide, 0.3 millimeters thick, and nine millimeters long, a size that can lend itself well to typical bi-pin and wedge interfaces. However, this size can vary from one embodiment to the next depending on the size of the bi-pin and wedge interfaces.

In a fashion similar to and often in conjunction with the bridge 110*a/b*, the overall configuration of the channel 112*a/b* can change from one embodiment to the next. For example, as a subelement of the converter 100 (as described above), the channel 112*a/b* can be formed in a variety of geometric configurations, materials, and sizes. FIGS. 1B and 1E illustrate that the channel 112*a/b* can, for example, be a substantially semicircular, defined by a surface of the bridge 110*a/b*.

Notwithstanding the geometric configuration of the bridge 110*a/b*, the bridge 110*a/b* can generally be formed from the same material as the flange 104*a/b*. As described above, this material can vary from one embodiment to the next.

In addition to various geometric configurations, the channel 112*a/b* can be configured in various sizes. For example, the channel 112*a/b* can be about 0.7 millimeters wide, 0.36 millimeters deep, and nine millimeters long, a size that can lend itself well to typical bi-pin and wedge interfaces. However, this size can vary from one embodiment to the next depending on the size of the bi-pin and wedge interfaces.

Like the flanges 104*a/b*, similar and often in conjunction with the converter 100, the overall configuration of the conductors 106*a/b* can change from one embodiment to the next. Specifically, as an element of the converter 100 (as described above), the conductors 106*a/b* can be formed in a variety of geometric configurations, materials, and sizes.

Figure 1C:
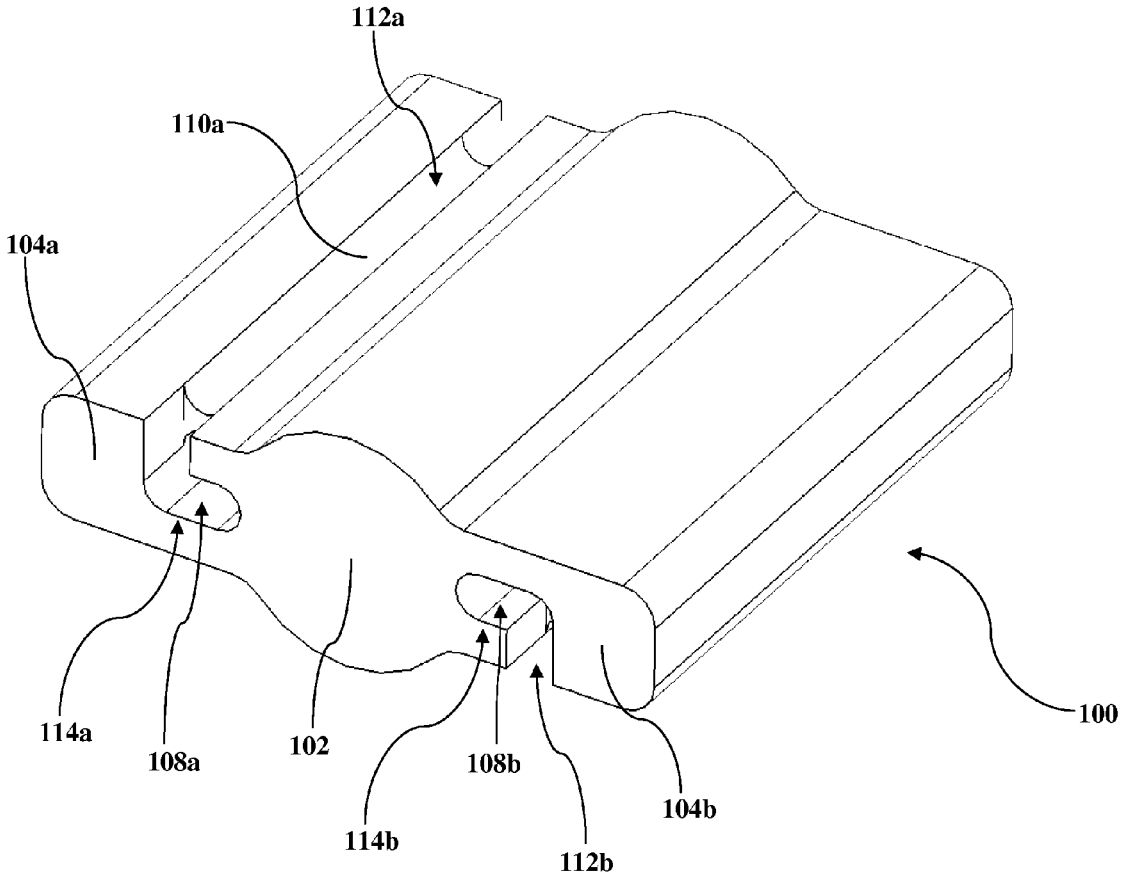
FIG. 1C depicts a perspective view of an example wedge converter in a different orientation.
Figure 1D:
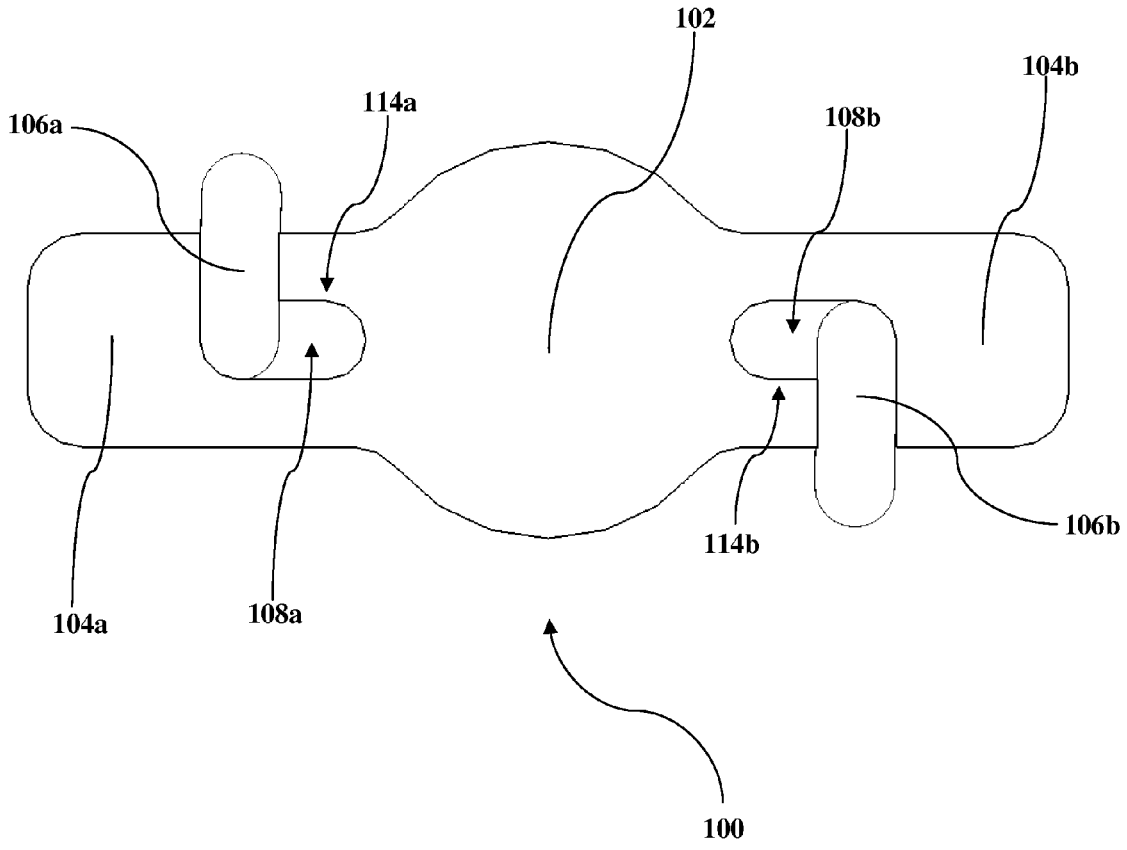
FIG. 1D depicts a cross-sectional end view of an example wedge converter.
Figure 1E:
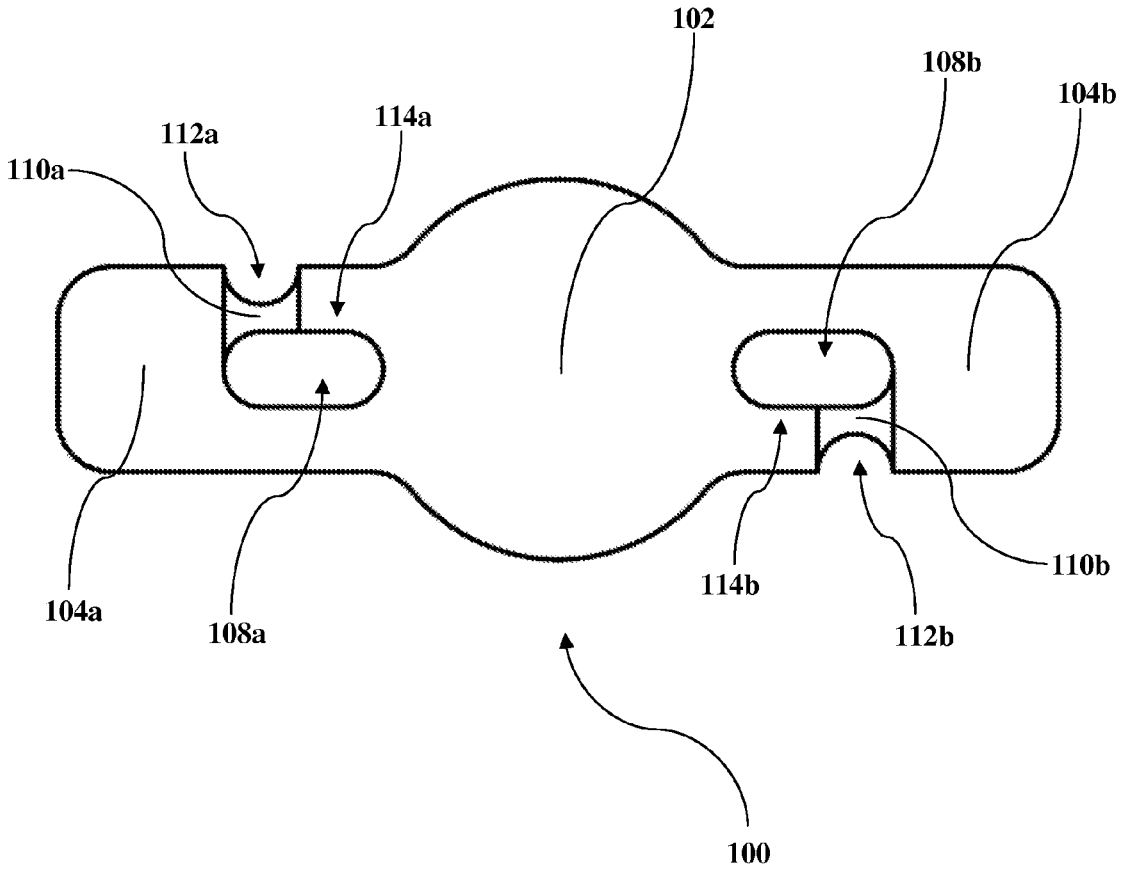
FIG. 1E depicts another cross-sectional end view of an example wedge converter.
Figure 1F:
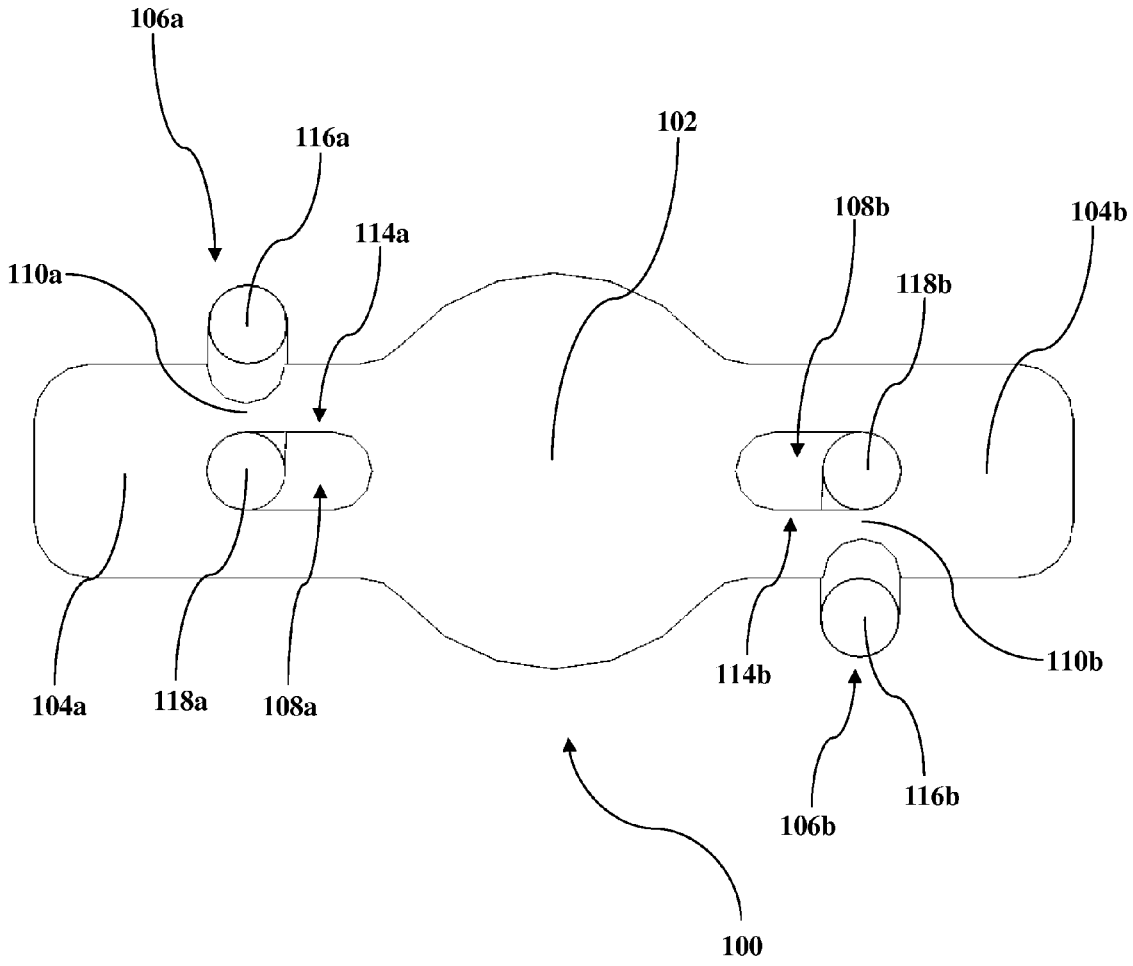
FIG. 1F depicts another cross-sectional end view of an example wedge converter in a different orientation.
Figure 1G:
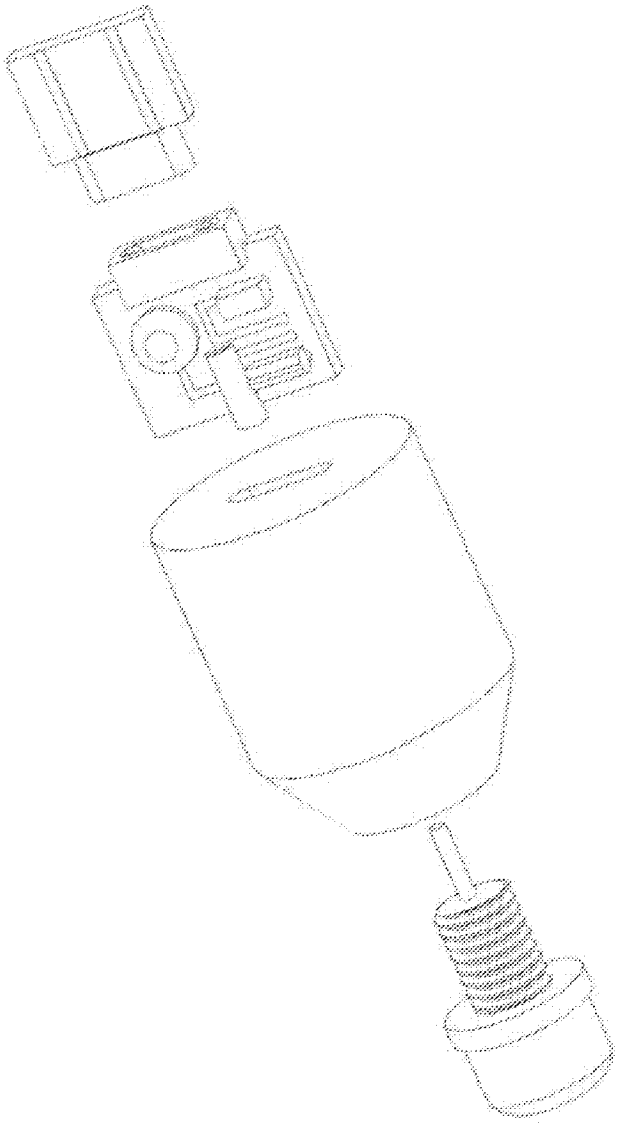
FIG. 1G depicts an example wedge convert for use on a lighting unit.

In one example embodiment, as illustrated in FIGS. 1A, 1D, and 1F, each conductor 106*a/b* can extend through both the hollow extension 108*a/b* and the channel 112*a/b*, forming a closed loop. But the conductor 106*a/b* can also be formed in a horseshoe configuration; the conductor 106*a/b* need not form a closed loop to perform its function.

As illustrated in FIGS. 1A and 1F, each conductor 106*a/b* can be substantially cylindrical and comprise several rounded bends. As will be described below, the overall configuration of the conductors 106*a/b*, and particularly their geometric configuration and size, can vary from one embodiment to the next. In addition, the overall configuration of the conductors 106*a/b* can be substantially dependent on the configuration of the wedge interface.

As will be described below, the overall configuration of each conductor 106*a/b*, and particularly its geometric configuration and size, can be substantially dependent on the configuration of the elements it can comprise. Specifically, as generally described above and illustrated in FIG. 1F, each conductor 106*a/b* can comprise a first electrical interface 116*a/b* and a second electrical interface 118*a/b*.

In a fashion similar to and often in conjunction with the conductor 106*a/b*, the overall configuration of the first electrical interface 116*a/b* can change from one embodiment to the next. For example, as a subelement of the converter 100 (as described above), the first electrical interface 116*a/b* can be formed in a variety of geometric configurations, materials, and sizes. FIG. 1F illustrates that the first electrical interface 116*a/b* can, for example, be a substantially cylindrical.

Notwithstanding the geometric configuration of the first electrical interface 116*a/b*, the first electrical interface 116*a/b* can be formed from a variety of materials. But the first electrical interface 116*a/b* can typically, by definition, be conductive. As a result, the first electrical interface will generally be formed from a conductive material, such as copper, gold, or silver.

In addition to various materials, the first electrical interface 116*a/b* can be configured in various sizes. For example, the first electrical interface 116*a/b* can be about 0.36 millimeters in radius (in a cylindrical embodiment) and nine millimeters long, a size that can lend itself well to typical bi-pin and wedge interfaces. However, this size can vary from one embodiment to the next depending on the size of the bi-pin and wedge interfaces.

In a fashion similar to and often in conjunction with the first electrical interface 116*a/b*, the overall configuration of the second electrical interface 118*a/b* can change from one embodiment to the next. In typical example embodiments, the second electrical interface 118*a/b* can closely resemble the first electrical interface 116*a/b*. In addition, the geometric configuration, material, and size of the second electrical interface 118*a/b* can vary in a fashion substantially similar to the first electrical interface 116*a/b*.

FIGS. 1A, 1D, and 1F illustrate the converter 100 assembled with the conductors 106*a/b*, whereas FIGS. 1B, 1C, and 1E illustrate the converter 100 without the conductors 106*a/b*. As illustrated in FIGS. 1A, 1D, and 1F, the conductors 106*a/b* can pass through the flanges 104*a/b* and form at least a partial loop around the flanges 104*a/b*. FIG. 1D illustrates that the conductors 106*a/b* can be configured around the flanges 104*a/b* such that both the pins of a bi-pin bulb and the electrical interfaces of a wedge interface can couple to the conductors 106*a/b*. FIG. 1D further illustrates that the conductors 106*a/b* can be positioned to run along opposite sides of the flanges 104*a/b*. FIGS. 1A and 1D will be used to discuss how the converter 100 generally functions to achieve this coupling. As described in detail above, the converter 100 can comprise a body 102, flanges 104*a/b*, and conductors 106*a/b*.

As illustrated in FIG. 1D, the body 102 can run through the middle of the converter 100 and can be substantially cylindrical. As illustrated FIG. 1A, the body 102 can run across the entire converter 100. The overall configuration of the body can be designed to conform to the configuration of the wedge interface into which the converter 100 can couple a bi-pin bulb. For example, the edges of many wedge interfaces have protruding rounded portions. The body 102 can thus be round, such that the general shape of the converter 100 conforms to the edge of the wedge interface. But as wedge interfaces can have a variety of geometric configurations, the body 102, in conjunction with the converter 100, can take on different geometric configurations to conform to such interfaces.

As illustrated in FIGS. 1A and 1D, the converter can comprise two flanges 104*a/b* that can extend from opposite sides of the body. As further illustrated in FIGS. 1A and 1D, the flanges 104*a/b* can be substantially rectangular. In example embodiments wherein the conductors 106*a/b* run along opposite sides of the flanges 104*a/b*, the bridges 110*a/b* and channels 112*a/b* can also be configured on opposite sides of the flanges 104*a/b*. But this opposite-side configuration is generally designed into the converter 100 in reaction to the configuration of the wedge interface. So in other example embodiments, the converter 100 can be altered to have both conductors 106*a/b*, and thus both bridges 110*a/b* and channels 112*a/b*, on the same sides of the flanges 104*a/b*. This allows the converter 100 to accommodate for configurations wherein the wedge electrical interfaces are both on the same side of the wedge interface.

Like the body 102 and the flanges 104*a/b*, the conductors 106*a/b* can also be configured in various manners. Typically the conductor 106*a/b* is formed from a cylindrical, elongated, piece of conductive material. As illustrated in FIGS. 1A and 1D, in one example embodiment, the conductors 106*a/b* can form closed loops around the flanges 104*a/b*. In such example embodiments, the conductor 106*a/b* can be bent partially into shape, inserted through the hollow extension 108*a/b*, and then bent fully into shape. At this point, the conductor 106*a/b* can fit snugly in the hollow extension 108*a/b*, secured by the interior walls 114*a/b*. The conductor 106*a/b* can also fit snugly within the channel 112*a/b*. The final assembly step is to close the loop of the conductor 106*a/b*, which can typically be done through welding. In example embodiments wherein the conductor 106*a/b* does not form a closed loop, welding is not necessary.

As illustrated in FIG. 1F, regardless of whether the conductor 106*a/b* forms a closed loop, the conductor 106*a/b* can typically be fastened within the flange by friction. This friction fastening can be realized through two design features. First, the shape of both the hollow extension 108*a/b* and channel 112*a/b* can be configured to complement the shape of the conductor 106*a*. Second, the radius of each of these shapes can be configured such that the conductor fits snugly within both the hollow extension 108*a/b* and the channel 112*a/b*. The combination of these design features ensures that the conductor 106*a/b* fits perfectly with the hollow extension 108*a/b* and the channel 112*a/b*, thus affecting the friction fastening.

But in other example embodiments, the fastening can be achieved through an adhesive, which can be applied between the conductor 106*a/b* and the channel 112*a/b* or hollow extension 108*a/b*. Adhesive fastening can be particularly desirable in applications wherein the lighting system will be jolted or will otherwise undergo harsh impacts. In ultra-high-impact applications, adhesive can be used in addition to friction fastening.

Regardless of how the conductors 106*a/b* are fastened to the flanges 104*a/b*, the components of the converter 100 can be aligned in a way that facilitates stability and durability, as well as electrical integrity. For example, as illustrated in FIGS. 1E and 1F, the hollow extensions 108*a/b* can be generally aligned to be on the same horizontal plane. This enables the bi pins to be inserted directly into the converter 100 without being twisted or otherwise contorted. This is important because twisting and contorting can, over time, lead to electrical and structural integrity problems with the pins.

FIGS. 1E and 1F further illustrate that the portion of the hollow extensions 108*a/b* into which the bi pins can be inserted can be generally aligned on the same vertical plane with the corresponding channels 112*a/b*. This allows for the alignment of the first electrical interface 116*a/b* with the second electrical interface 118*a/b*, such that the conductors 106*a/b* need not be twisted or otherwise contorted to couple the bi pins to the wedge interface. Again, this is important to avoid structural and electrical integrity problems that may result over time, as a result of twisting.

In other example embodiments, the portion of the hollow extension 108*a/b* into which the bi pin is inserted will not be aligned with the channel 112*a/b*. When the electrical interfaces of the wedge interface are spaced differently than the bi pins, this variable spacing between the hollow extensions 108*a/b* and the channels 112*a/b* allows for an electrical conversion without requiring the bi pins to be stretched or bent. As described above, stretching or contorting the bi pins can results in integrity problems.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A converter for converting a bi-pin interface to a wedge interface, the converter comprising:
- a body;
- a flange extending from the body;
- a first bridge arranged between the flange and the body;
- a channel formed on the bridge;
- a hollow extension defined by the body and the first bridge; and
- a conductor passing through the hollow extension and the channel, the conductor comprising a first electrical interface configured to electrically connect to the bi-pin interface and a second electrical interface configured to electrically connect to the wedge interface.

2. The converter of claim 1, wherein the conductor comprises a substantially cylindrical wire that forms a loop around the bridge.

3. The converter of claim 1, wherein the conductor substantially surrounds the bridge in a close loop configuration.

4. The converter of claim 1, wherein the conductor substantially surrounds the bridge in an open loop configuration.

5. The converter of claim 1, further comprising a second bridge formed on a side of the converter same as the first bridge.

6. The converter of claim 1, further comprising a second bridge formed on a side of the converter opposite to the first bridge.

7. The converter of claim 1, wherein the body is substantially arranged in a geometric center of the converter.

* * * * *